US008287335B2

(12) United States Patent
Chang

(10) Patent No.: US 8,287,335 B2
(45) Date of Patent: Oct. 16, 2012

(54) ABRASIVE APPARATUS OF A SANDER

(75) Inventor: Richard Chang, Fang Yuan (TW)

(73) Assignee: Kingsand Machinery Ltd., Taichung Hsien (TW)

( * ) Notice: Subject to any disclaimer, the term of this patent is extended or adjusted under 35 U.S.C. 154(b) by 434 days.

(21) Appl. No.: 12/760,657

(22) Filed: Apr. 15, 2010

(65) Prior Publication Data

US 2011/0256816 A1 Oct. 20, 2011

(51) Int. Cl.
*B24B 41/00* (2006.01)

(52) U.S. Cl. ..... 451/360; 451/11

(58) Field of Classification Search ..... 451/178, 451/360, 120, 124, 130, 109, 110, 119, 150, 451/131, 338, 361–363, 340, 11; 144/38, 144/190, 194, 195, 114.1, 117.1, 121, 129, 144/130

See application file for complete search history.

(56) References Cited

U.S. PATENT DOCUMENTS

| | | | | | |
|---|---|---|---|---|---|
| 2,656,861 | A * | 10/1953 | Verret | 144/1.1 |
| 5,056,272 | A * | 10/1991 | Battaglia | 451/41 |
| 5,531,636 | A * | 7/1996 | Bissen | 451/130 |
| 6,146,254 | A * | 11/2000 | Wang | 451/65 |
| 6,743,084 | B1 * | 6/2004 | Cheng | 451/299 |
| 7,090,569 | B1 * | 8/2006 | Chang | 451/120 |

* cited by examiner

*Primary Examiner* — Dung Van Nguyen
(74) *Attorney, Agent, or Firm* — Ming Chow; Sinorica, LLC

(57) ABSTRACT

An abrasive apparatus of a sander is provided. The abrasive apparatus is disposed above a worktable of the sander and includes a base and a lift unit. At least one abrasive wheel is provided in the base. The base has a top formed with at least one slot. The lift unit is disposed on the abrasive wheel to bring the abrasive wheel to move up so that an abrasive surface of the abrasive wheel passes through the slot of the base and protrudes from the base for the top of the base to sand the side of a workpiece. The cutting width of the sander can be extended to enhance the use of the sander, so the manufacturing process can be shortened to increase the production efficiency.

6 Claims, 5 Drawing Sheets

ABRASIVE APPARATUS OF A SANDER

BACKGROUND OF THE INVENTION

1. Field of the Invention

The present invention relates to an abrasive apparatus of a sander.

2. Description of the Prior Art

As shown in FIG. 1, a conventional sander comprises a worktable 1. The worktable 1 comprises a pair of slide seats 2 at two sides thereof. The slide seats 2 are slidably connected to an abrasive apparatus 4 through four screws 3. The abrasive apparatus 4 is driven by a swing arm 5 which is connected to one of the screws 3 to move up or down within the slide seats 2, such that the abrasive position can be adjusted according to the thickness of a plank 6. However, the height of adjustment between the abrasive apparatus 4 and the worktable 1 is limited. If the plank 6 is too tall, the abrasive apparatus 4 can only sand the bottom and the top of the plank 6. The sides of the plank 6 can not be sanded by the abrasive apparatus 4 of the sander. It is necessary to use another apparatus, such as a trimmer, for a second processing. Thus, the production cost is increased and the factory building needs more space and the production process is lengthened. Accordingly, the inventor of the present invention has devoted himself based on his many years of practical experiences to solve this problem.

SUMMARY OF THE INVENTION

The present invention is to provide an abrasive apparatus of a sander. The abrasive apparatus is disposed above a worktable of the sander and includes a base and a lift unit. The base has an accommodation room therein and at least one abrasive wheel pivotally connected in the accommodation room. The base has a top formed with at least one slot. The slot communicates with the accommodation room. The lift unit is disposed on the abrasive wheel to bring the abrasive wheel to move up so that an abrasive surface of the abrasive wheel passes through the slot of the base and protrudes from the base for the top of the base to sand the top and the bottom of a workpiece. The side of the workpiece can be directly sanded on top of the base. The cutting width of the sander can be extended to enhance the use of the sander, so the manufacturing process can be shortened to increase the production efficiency and save the cost for the factory building.

DETAILED DESCRIPTION OF THE PREFERRED EMBODIMENTS

Embodiments of the present invention will now be described, by way of example only, with reference to the accompanying drawings.

Figure 1:
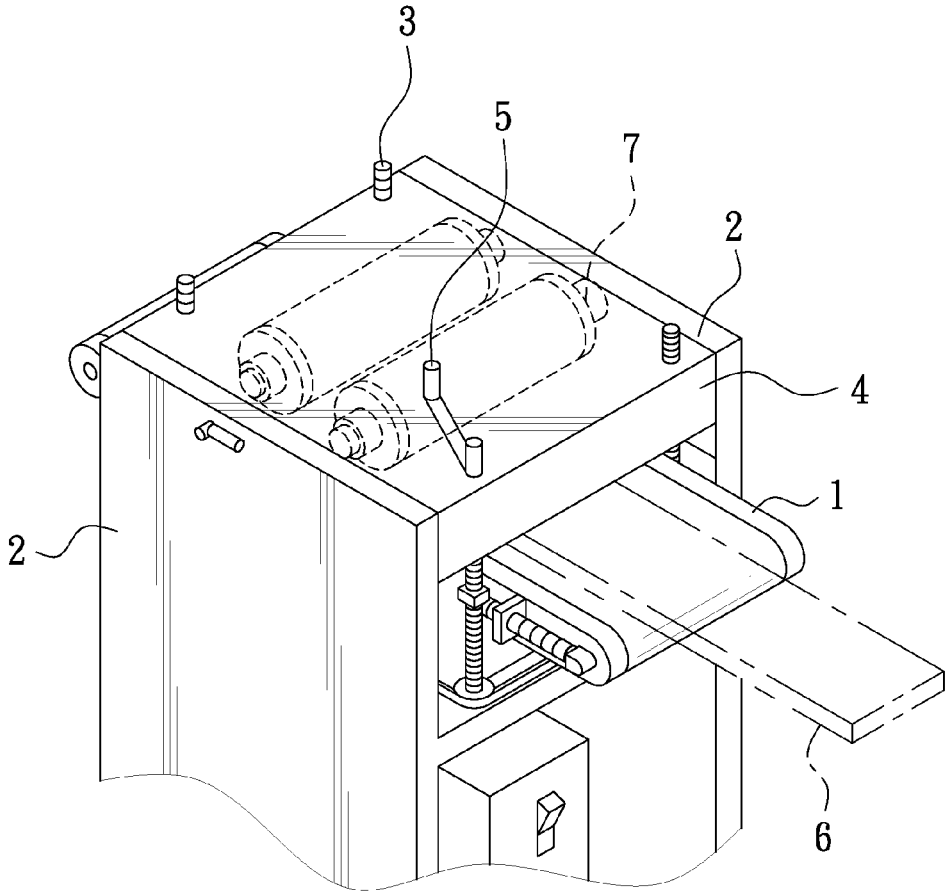
FIG. 1 PRIOR ART
FIG. 1 is a perspective view of a conventional sander.
Figure 2:
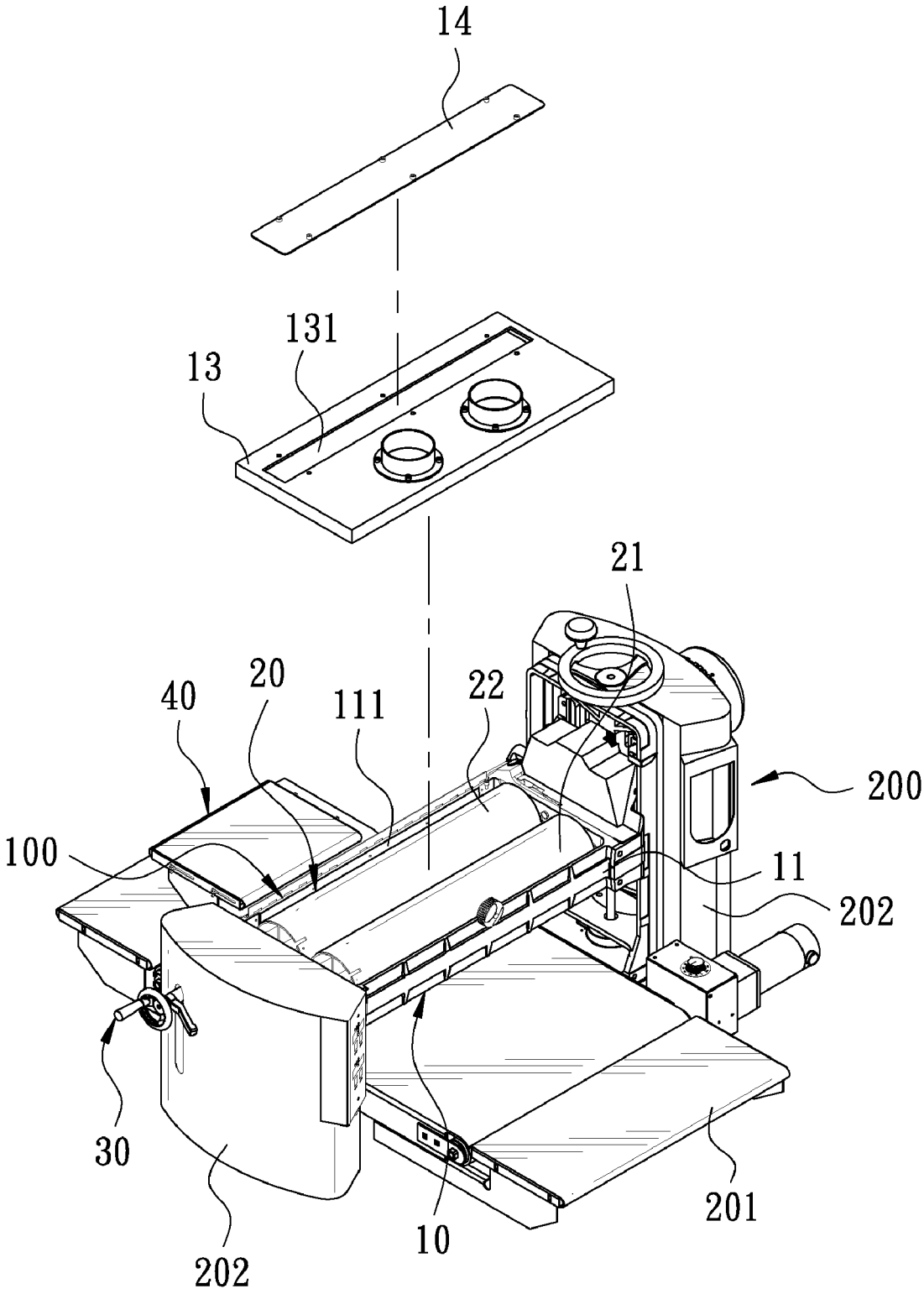
FIG. 2 is a partially exploded view according to a preferred embodiment of the present invention.
Figure 3:
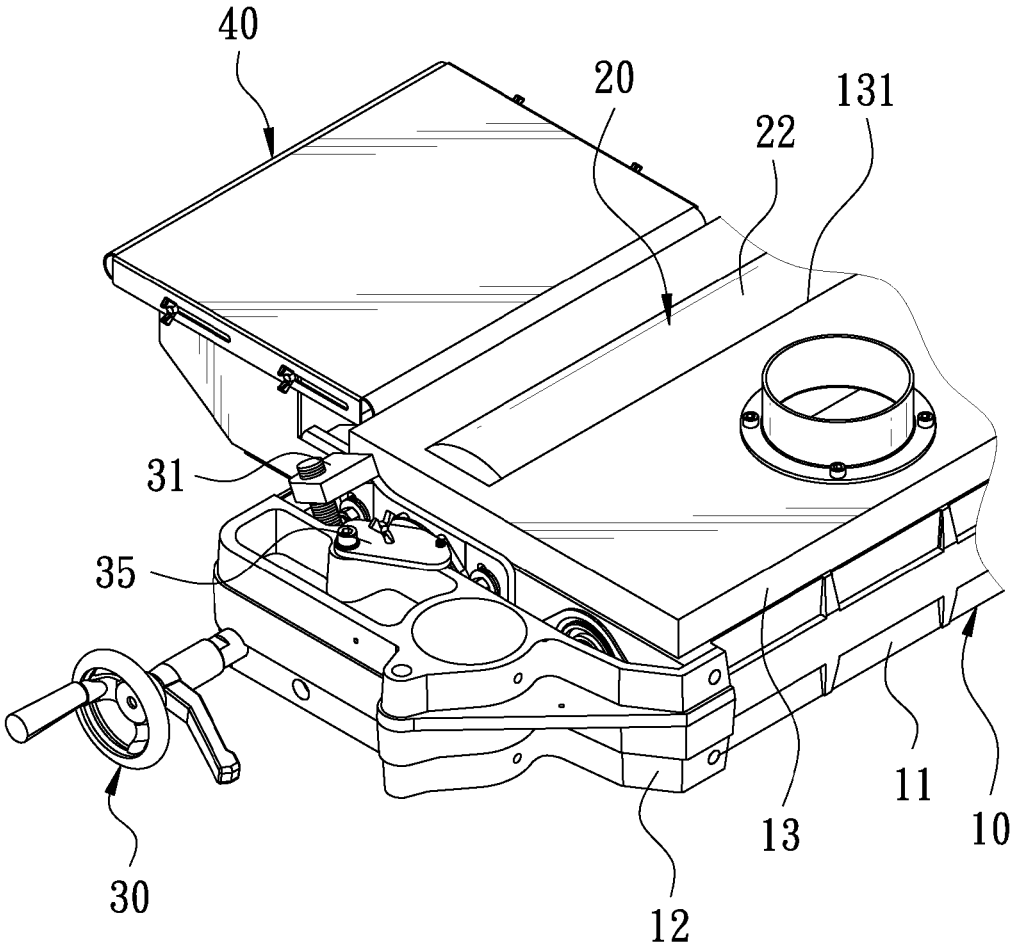
FIG. 3 is a partially enlarged perspective view according to the preferred embodiment of the present invention.
Figure 4:
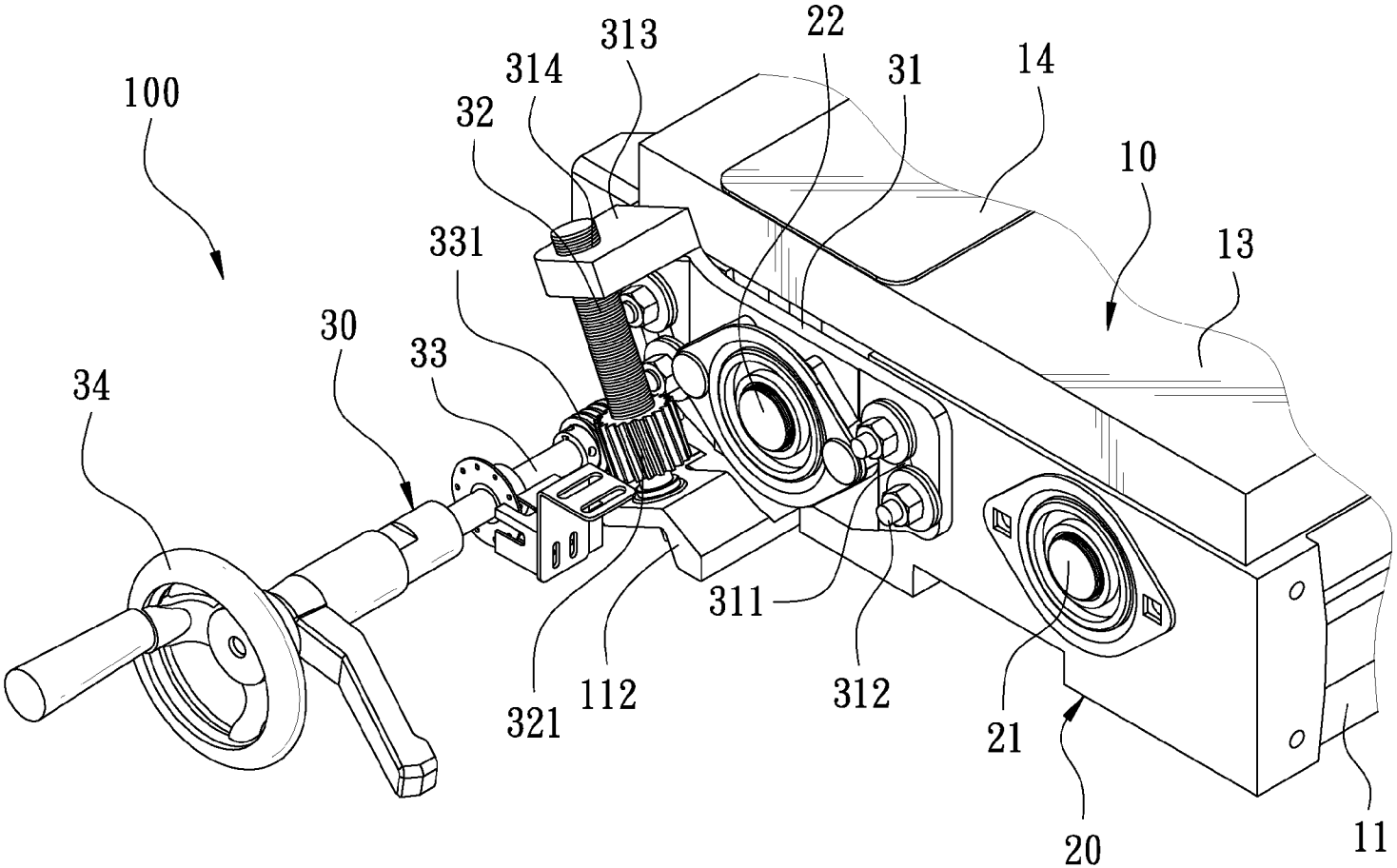
FIG. 4 is a perspective view showing the lift unit according to the preferred embodiment of the present invention.

As shown in FIGS. 2 to 4, an abrasive apparatus 100 according to a preferred embodiment of the present invention is mounted on a sander 200. The sander 200 comprises a worktable 201. The worktable 201 comprises a pair of slide seats 202 at two sides thereof. The abrasive apparatus 100 is disposed between the pair of slide seats 201. The abrasive apparatus 100 comprises a base 10, a lift unit 30, and a support platform 40.

The base 10 has an annular base body 11. The base body 11 has a pair of connection seats 12 at two sides thereof. The connection seats 211 are slidably connected to the slide seats 202. The base body 11 has an accommodation room 111 therein. An abrasive wheel 20 is pivotally connected in the accommodation room 111. In this embodiment, there are two abrasive wheels 20 in the accommodation room 111. The two abrasive wheels 20 are a coarse abrasive wheel 21 and a fine abrasive wheel 22. A cover 13 is provided on the base body 11. The cover 13 has a slot 131 corresponding to the fine abrasive wheel 22. The slot 131 communicates with the accommodation room 111. An upper lid 14 is provided on the slot 131.

The lift unit 30 is disposed at one end of the fine abrasive wheel 22. The lift unit 30 comprises a positioning plate 31, a screw 32, a driving rod 33, a hand wheel 34, and a return-to-zero plate 35. The positioning plate 31 is pivotally connected to one end of the fine abrasive wheel 22. The positioning plate 31 has two slide slots 311 disposed close to two ends of the positioning plate 31. The positioning plate 31 is slidably connected to the base body 11 of the base 10 through two bolts 312. The positioning plate 31 has a connection block 313 protruding from an upper end thereof. The connection block 313 has a threaded hole 314. The base body 11 has an extension block 112 corresponding to the connection block 313. One end of the screw 32 is screwed to the threaded hole 314, while another end of the screw 32 is provided with a worm gear 321 and pivotally connected to the extension block 112 of the base body 11. The screw 32 is parallel to the slide slot 311 of the positioning plate 31. The driving rod 33 is parallel to the fine abrasive wheel 22. A first end of the driving rod 33 is axially connected to one side of the base 10, while a second end of the driving rod 33 is protruded out of the base 10 and connected with the hand wheel 34. The first end of the driving rod 33 has a threaded section 331 to mesh with the worm gear 321 of the screw 32 for driving the screw 32. The return-to-zero plate 35 is pivotally connected to the connection seat 12 of the base 10 and located close to the positioning plate 31 for selectively stopping a top surface of the positioning plate 31 to assist the fine abrasive wheel 22 in returning to zero.

The support platform 40 is disposed at one side of the base 10.

Figure 5:
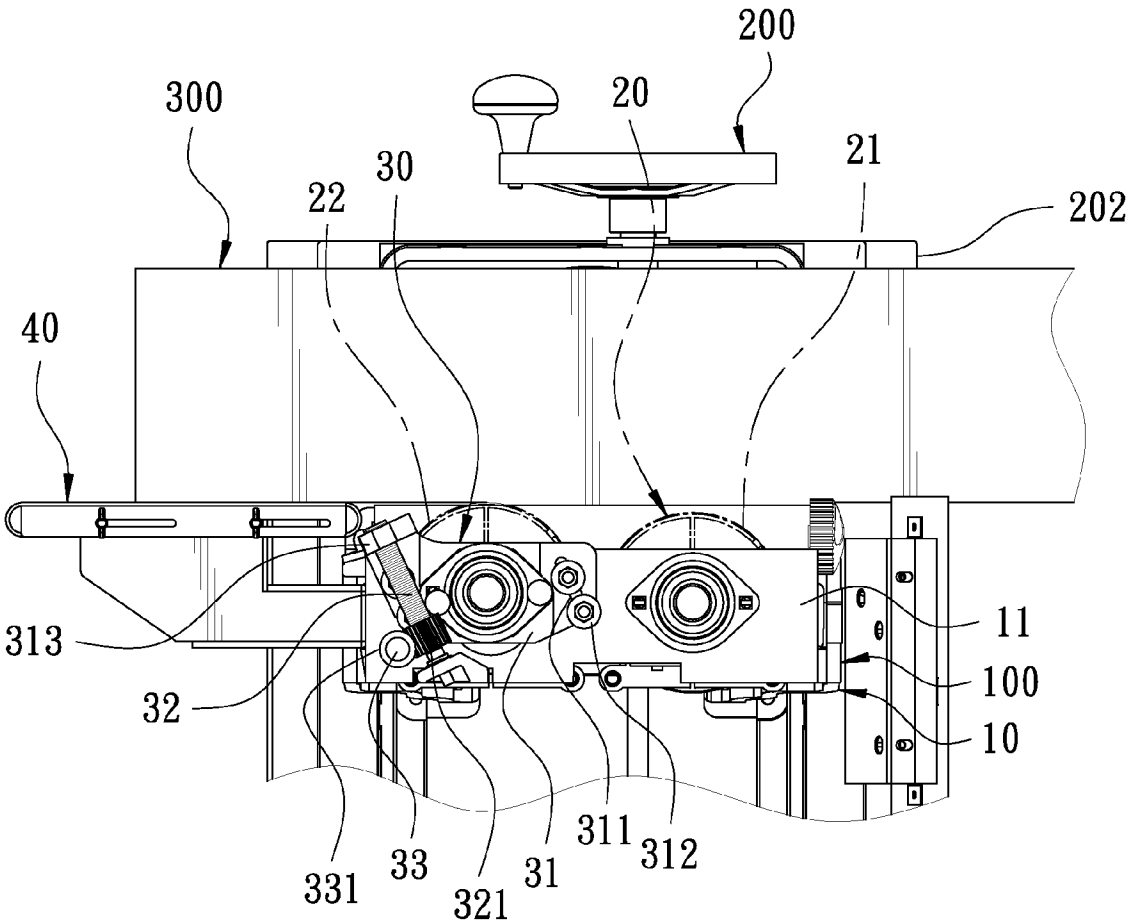
FIG. 5 is a schematic view of the preferred embodiment of the present invention when in use.

FIG. 5 is a schematic view of the preferred embodiment of the present invention when in use. When the operator wants to sand a workpiece 300 on top of the base 10, the upper lid 14 of the base 10 is first taken apart to expose the slot 131 on top of the base 10, and then the hand wheel 34 is turned to drive the driving rod 33 for turning the screw 32. Because one end of the screw 32, opposite to the threaded hole 314, is pivotally connected to the extension block 112 of the base 10, the screw 32 will be moved in the threaded hole 314. The positioning plate 31 is guided by the slide slot 311 to move the fine abrasive wheel 22 toward the slot 131 of the base 10, so that the abrasive surface of the fine abrasive wheel 22 is exposed out of the base 10. As shown in FIG. 5, after the top and the bottom of the workpiece 300 are sanded, the side of the workpiece 300 can be directly sanded on top of the base 10. The cutting width of the sander 200 can be extended to enhance the use of the sander 200, so the manufacturing process can be shortened to increase the production efficiency and save the cost for the factory building. The support platform 40 is to provide an auxiliary support effect, which can prevent the workpiece 300 from jump during the processing to enhance the grind quality. Besides, with the return-to-zero plate 35, the present invention provides a quick positioning effect to assist the fine abrasive wheel 22 in returning to zero.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. An abrasive apparatus of a sander, disposed above a worktable of the sander, the abrasive apparatus comprising:

a base having an accommodation room therein and at least one abrasive wheel pivotally connected in the accommodation room, the base having a top formed with at least one slot, the slot communicating with the accommodation room; and a lift unit disposed on the abrasive wheel to bring the abrasive wheel to move up so that an abrasive surface of the abrasive wheel passes through the slot of the base and protrudes from the base for the top of the base to sand a workpiece.

2. The abrasive apparatus of a sander as claimed in claim 1, wherein the base has an annular base body, a cover being provided on the base body, the cover having the slot.

3. The abrasive apparatus of a sander as claimed in claim 1, wherein the lift unit comprises a positioning plate, a screw, a driving rod and a hand wheel, the positioning plate being pivotally connected to one end of the abrasive wheel, the positioning plate having a connection block protruding from an upper end thereof, the connection block having a threaded hole, one end of the screw being screwed to the threaded hole, another end of the screw being provided with a worm gear and pivotally connected to the base, the driving rod being parallel to the abrasive wheel, a first end of the driving rod being axially connected to one side of the base, a second end of the driving rod being protruded out of the base and connected with the hand wheel, the first end of the driving rod having a threaded section to mesh with the worm gear of the screw.

4. The abrasive apparatus of a sander as claimed in claim 3, wherein the lift unit further comprises a return-to-zero plate, the return-to-zero plate being pivotally connected to the base and located close to the positioning plate.

5. The abrasive apparatus of a sander as claimed in claim 1, wherein the base has an upper lid which is disposed on the slot.

6. The abrasive apparatus of a sander as claimed in claim 1, wherein the base comprises a support platform at one side of the base.

* * * * *